US010436189B2

(12) United States Patent
McMullen

(10) Patent No.: US 10,436,189 B2
(45) Date of Patent: Oct. 8, 2019

(54) COMPRESSOR GAS CUTOFF

(71) Applicant: Donald R. McMullen, Orange, TX (US)

(72) Inventor: Donald R. McMullen, Orange, TX (US)

(73) Assignee: Donald R. McMullen, Orange, TX (US)

( * ) Notice: Subject to any disclaimer, the term of this patent is extended or adjusted under 35 U.S.C. 154(b) by 164 days.

(21) Appl. No.: 15/440,847

(22) Filed: Feb. 23, 2017

(65) Prior Publication Data

US 2018/0238322 A1 Aug. 23, 2018

(51) Int. Cl.
*F16K 31/12* (2006.01)
*F04B 49/03* (2006.01)
(Continued)

(52) U.S. Cl.
CPC ..... *F04B 49/03* (2013.01); *F04B 39/08* (2013.01); *F04B 39/10* (2013.01); *F04B 49/225* (2013.01);
(Continued)

(58) Field of Classification Search
CPC ..... Y10T 137/2521; Y10T 137/741; Y10T 137/7436; Y10T 137/7723; Y10T 137/7726; Y10T 137/7727; Y10T 137/7731; Y10T 137/7733; Y10T 137/7787; Y10T 137/7835;
(Continued)

(56) References Cited

U.S. PATENT DOCUMENTS 2,390,642 A * 12/1945 Curry ..... F16K 17/00 137/154
2,529,770 A * 11/1950 Hanson ..... F16K 17/00 137/38

(Continued)

*Primary Examiner* — Robert K Arundale
(74) *Attorney, Agent, or Firm* — Park, Vaughan, Fleming & Dowler LLP

(57) ABSTRACT

Embodiments of a compressor cutoff are presented. In an embodiment, the present invention includes apparatus for cutting off the flow of gas/liquid in the event of compressor failure or breakdown. In this embodiment, gas/liquid flows from its source through one or more passageways into a first input chamber, and also through one or more other passageways into a second input chamber, where the first and second input chambers are separated by a stop plunger. During the down-stroke of the compressor's piston, gas/liquid in the first chamber passes (or is drawn) through an inlet valve of the piston bore, and during the up-stroke of the piston that gas/liquid is forced through an outlet valve to a tank or other compressed gas/liquid receptacle. So long as the compressor operates normally, the pressure in the two input chambers (i.e., on each side of the stop plunger) will be substantially equal, thereby keeping the stop plunger in place. If, however, the compressor fails in a manner that exposes gas/liquid in the piston bore to the atmosphere, or otherwise results in a decrease in pressure in the piston bore, the pressure in the first input chamber will fall below the pressure in the second input chamber, thereby causing the stop plunger to move to a position in which it blocks the flow of gas/liquid from entering the inlet valve of the piston bore.

31 Claims, 9 Drawing Sheets

(51) Int. Cl.
*F04B 39/08* (2006.01)
*F04B 49/22* (2006.01)
*F04B 39/10* (2006.01)

(52) U.S. Cl.
CPC .... *Y10T 137/7726* (2015.04); *Y10T 137/7733* (2015.04); *Y10T 137/7787* (2015.04)

(58) Field of Classification Search
CPC ..... Y10T 137/7839; Y10T 137/7739; Y10T 137/7729; Y10T 137/2499; F04B 49/03
See application file for complete search history.

(56) References Cited

U.S. PATENT DOCUMENTS 2,621,885 A * 12/1952 Schmitt ..... F16K 1/465 251/324
2,744,537 A * 5/1956 Clark ..... G05D 16/10 137/462
4,014,510 A * 3/1977 Smith ..... F16K 31/122 251/63
4,732,190 A * 3/1988 Polselli ..... F16K 17/24 137/460
6,732,519 B2 * 5/2004 Nakano ..... B60T 15/36 251/63
6,752,376 B1 * 6/2004 Satou ..... F16K 7/123 251/331
8,231,101 B2 * 7/2012 Hagihara ..... F16K 7/14 251/331

* cited by examiner

COMPRESSOR GAS CUTOFF

FIELD

This disclosure relates generally to compressors, and more specifically, to a mechanism for cutting off the flow of gas, liquid, or the combination thereof in the event of compressor failure or malfunction.

BACKGROUND

In today's world of pneumatic operations, it is hard to imagine a time when air compressors were nonexistent in factories or workshops. The fact is, in the context of machine-age history, air compressors are a relatively recent innovation. Not long ago, the air tools used in workshops typically drew power from complex systems comprised of belts, wheels, and other large components. For the most part, such machinery was too massive, heavy, and costly for smaller operations, and was therefore confined primarily to larger companies.

Today, however, air compressors are usually found at factories where products are assembled or in most places where cars are serviced, such as gas stations and auto workshops. The list of tools that run on compressed air is long, but some of the most common pneumatic tools include the following: drills, grinders, nail guns, sanders, spray guns, and staplers. The most significant benefit of the standard workshop air compressor is its compact and relatively lightweight dimensions, which stand in contrast to centralized sources of power that generally utilize large motors. Additionally, air compressors last longer, require less maintenance, are easier to move from worksite to worksite, and are far less noisy than old-fashioned machinery.

Air compression is essentially a twofold process in which the pressure of air rises while the volume drops. In most cases, compression is accomplished with reciprocating piston technology, which makes up the vast majority of compressors on the market. Every compressor with a reciprocating piston has the following parts: crankshaft; connecting rod; cylinder; piston; and valve head.

Air compressors, for the most part, are powered by either gas or electric motors—it varies by model. At one end of the cylinder are the inlet and discharge valves. Shaped like metal flaps, the two valves typically appear at opposite sides of the cylinder's top end. During the "compression" process, what the piston effectively does with its back and forth movements is create a vacuum. As the piston retracts (i.e., on its down-stroke), the space in front gets filled with air, which is sucked through the inlets from the outside or from another gas source. When the piston extends (i.e., on its upstroke), that same air is compressed and therefore given the strength to push through the discharge valve—simultaneously holding the inlet shut—and into a tank or other compressed gas receptacle. As more air is sent into the tank, the pressure gains intensity.

In certain air compressor models, the pressure is produced with rotating impellers. However, the models that are typically used by mechanics, construction workers, and crafts people tend to run on positive displacement, in which air is compressed within compartments that reduce its space. Even though some of the smallest air compressors consist of merely a motor and pump, the vast majority have air tanks. The purpose of the air tank is to store amounts of air within specified ranges of pressure until it is needed to perform work. In turn, the compressed air is used to power the pneumatic tools connected to the unit supply lines. While all of this is going on, the motor repeatedly starts and stops to keep the pressure at a desired consistency.

In order to accommodate the vast range of pneumatic tools on the market, air compressors are manufactured in both one- and two-cylinder varieties. However, compressors used by private craftspeople and contractors often contain two-cylinders that function almost identically to single cylinders, the only real difference being that two strokes occur during each revolution. Some two-cylinder machines that are marketed to the public also work in two stages, where one piston sends compressed air to another cylinder for further compression.

For most single-stage air compressors, the preset pressure limit is set to a specific pressure per square inch ("psi"). When this limit is reached, a pressure switch goes off to stop the motor. In most operations, however, there is no need to even reach the pressure limit. For that reason, the compressor's air line is set to a regulator, where the user inputs the appropriate pressure level for a given tool. The regulator is bookended by two gauges: one that comes in front to monitor the pressure of the tank, and another gauge at the end to keep the pressure of the air line in check. Furthermore, the tank may be equipped with an emergency valve that triggers in the event of a mishap with the pressure switch. On some models, the switch might connect with an unloader valve, which can help reduce stress to the tank at times when the machine is deactivated.

For certain heavy-duty industrial operations, piston compressors are considered insufficient. In order to get the pressure intensity needed for complex pneumatic and other high-powered tools, professionals will generally opt for rotary screw air compressors. Unlike the piston air compressor, which relies on pulsation, the rotary screw air compressor produces an ongoing movement to generate power.

In a rotary screw compressor, air is compressed with a meshing pair of rotors. As the screws move in rotation, fluids gets sucked in, compressed, and ejected. In order to keep leakage rates at an absolute minimum, fast rotational rates are vital throughout the operation.

While compressors often are used to compress air from the atmosphere, compressors also can be used to compress other gases and liquids, or even combinations thereof. The type of gas/liquid compressed obviously is application dependent. Nevertheless, for applications that call for compressing gas/liquid that is dangerous or otherwise harmful to humans and/or the environment, additional care must be taken to prevent exposures, whether during normal operation or during compressor breakdown or failure. Such failure or breakdown can occur when any of the compressor components such as the crankshaft, connecting rod, cylinder, piston, rotor, or valve head fail in a manner that allows gas/liquid to escape to the atmosphere or open environment.

One precaution taken for dangerous gas/liquid applications is to enclose the compressor in an airtight enclosure so that any catastrophic failure to the compressor that might vent gas/liquid to the atmosphere is trapped in the enclosure. This has proven cumbersome and inefficient since it significantly adds to the size of the compressor unit, detracts from easy access to the compressor, and can hold too much heat. Accordingly, a better apparatus is needed for preventing gas/liquid exposures during compressor failure or breakdown.

SUMMARY

In one embodiment, the present invention includes a means for cutting off the flow of gas or liquid (or a combination thereof) in the event of compressor failure or breakdown. In this embodiment, the gas/liquid flows from its source through one or more passageways into a first input chamber, and also through one or more other passageways into a second input chamber, where the first and second input chambers are separated by a stop plunger. During the down-stroke of the piston, the gas/liquid in the first chamber passes (or is drawn) through an inlet valve of the piston bore, and during the up-stroke of the piston, that gas/liquid is forced through an outlet valve of the piston bore to a tank or other compressed gas/liquid receptacle. So long as the compressor operates normally, the pressure in the two input chambers (i.e., on each side of the stop plunger) will be substantially equal, thereby keeping the stop plunger in place. If, however, the compressor fails in a manner that exposes gas/liquid in the piston bore to the atmosphere, or otherwise results in a decrease in pressure in the piston bore, the pressure in the first input chamber will fall below the pressure in the second input chamber, thereby causing the stop plunger to move to a position in which it blocks the flow of gas/liquid from entering the inlet valve of the piston bore. In that case, harmful gas/liquid from its source will cease (or substantially cease) flowing, thereby preventing harmful gas/liquid exposures during compressor failure or breakdown.

DRAWINGS

The following drawings form part of the present specification and are included to further demonstrate certain aspects of the present invention. While the invention in not limited to the following drawings, it may be better understood by reference to one or more of them in combination with the detailed description of specific embodiments presented herein. Moreover, while some of the descriptions of the drawings refer to "gas" being used, it should be understood that liquids (or a gas/liquid combination) could also be used without departing from the disclosed invention.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

Figure 1:
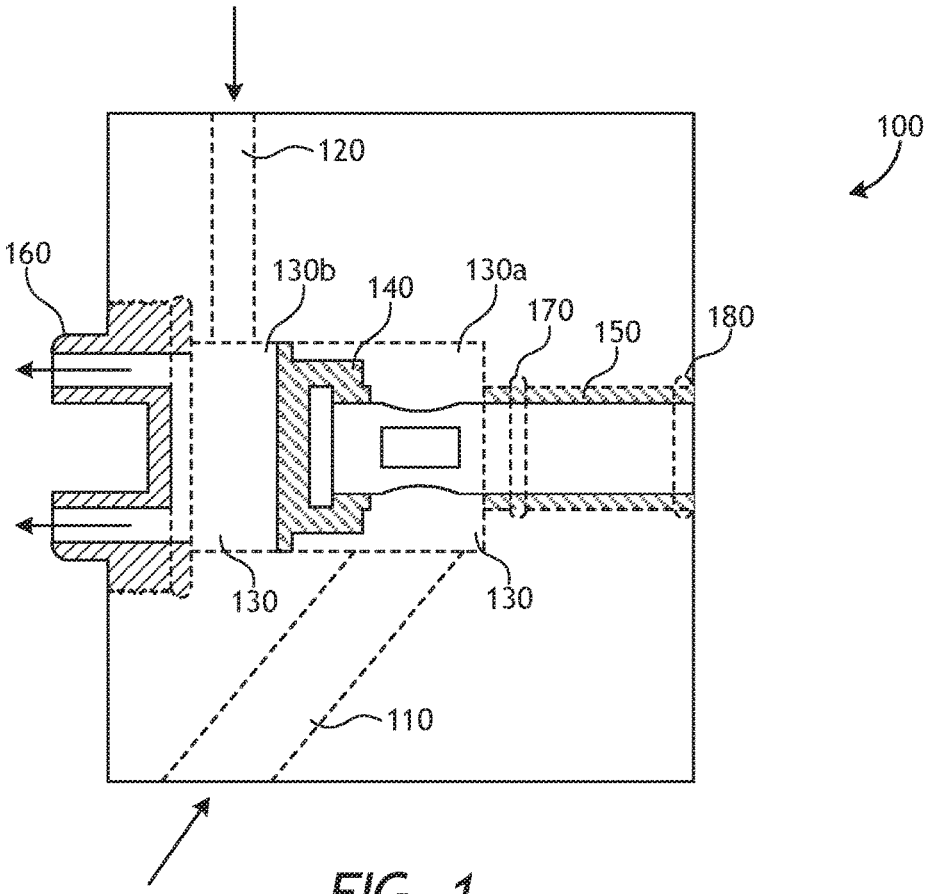
FIG. 1 is a cross sectional view of an exemplary embodiment of a gas block.

FIG. 1 is a cross sectional view of one exemplary embodiment of one aspect of the present invention. (As noted above, while references are made to "gas", it should be understood that liquids (or a gas/liquid combination) could also be used without departing from the disclosed invention.) Gas block 100 is shown having gas input passageway 110, gas input passageway 120, gas input chamber 130 (including input chamber 130*a* and input chamber 130*b*), stop plunger 140, groove 150 for receiving a portion of stop plunger 140, and gas outlet 160. In operation, gas is supplied, either from the atmosphere or from an external source, to gas passageway 110 and gas passageway 120, as depicted by the arrows showing gas flow into those passageways. Given this exemplary embodiment's structure, gas supplied to gas passageway 110 enters gas input chamber 130 at input chamber 130*a*, and gas supplied to gas passageway 120 enters gas input chamber 130 at input chamber 130*b*. The boundary between input chamber 130*a* and input chamber 130*b* is stop plunger 140, which is sized and mounted in block 100 so that it can slide between various positions in input chamber 130. In another embodiment, instead of separate passageways 110 and 120, a single gas passageway could straddle input chamber 130*a* and input chamber 130*b* so as to supply gas to both chambers from a single passageway.

As gas enters input passageway 120 and input chamber 130*b*, it flows to (and through) gas outlet 160, as shown by the exiting arrows in FIG. 1. The gas then flows as conventionally understood, i.e., through an inlet valve in the compressor (not shown) and into the compressor's piston bore (not shown). This described gas flow occurs at least on the down-stroke of the piston and ceases upon the piston's upstroke, at which point gas is forced through an outlet valve (not shown) to a tank or other compressed gas receptacle (not shown). Throughout this cycle, i.e., during normal compressor operation, gas pressure in input chamber 130*a* and input chamber 130*b* is substantially equal, thereby causing stop plunger 140 to remain in its position (as shown) between input passageway 110 and input passageway 120. Movement of stop plunger 140 can be retarded (to deter its movement during shipping, installation, vibration, minor gas pressure differentials, etc.) by one or more o-rings 170 and 180. Other movement retarding mechanisms could also be used instead of (or in combination with) o-ring 170 and 180, such as one or more springs, c-rings, or even merely friction between stop plunger 140 and grove 150.

If the compressor fails in a manner that exposes gas in the piston bore (or anywhere at or downstream of gas outlet 160) to the atmosphere, or otherwise results in a decrease in pressure in the piston bore, the pressure in input chamber 130*b* will fall below the pressure in input chamber 130*a* because chamber 130*b* will essentially be open to the atmosphere due to its connection to the piston bore. The pressure differential between chamber 130*a* and 130*b* will then cause stop plunger 140 to move to a position against gas outlet 160, thereby blocking the flow of gas from entering gas outlet 160 and the inlet valve of the piston bore. In that case, harmful gas from the gas source (being delivered through gas passageways 110 and 120) will cease flowing, thereby preventing harmful gas exposures during compressor failure or breakdown.

While various dimensions and geometries of gas block 100 and its constituent components are shown in FIG. 1 (and the other Figures), it should be understood that the invention is not limited to such dimensions and geometries. As one example only, while stop plunger 140 is shown having a flat, circular front surface for blocking gas outlet 160, the front surface of stop plunger 140 alternately could be spherical or otherwise shaped so long as its shape operates to block gas outlet 160 at the appropriate time. Gas block 100 and its other components could likewise be altered and still fall within the spirit and scope of the present invention.

Figure 2:
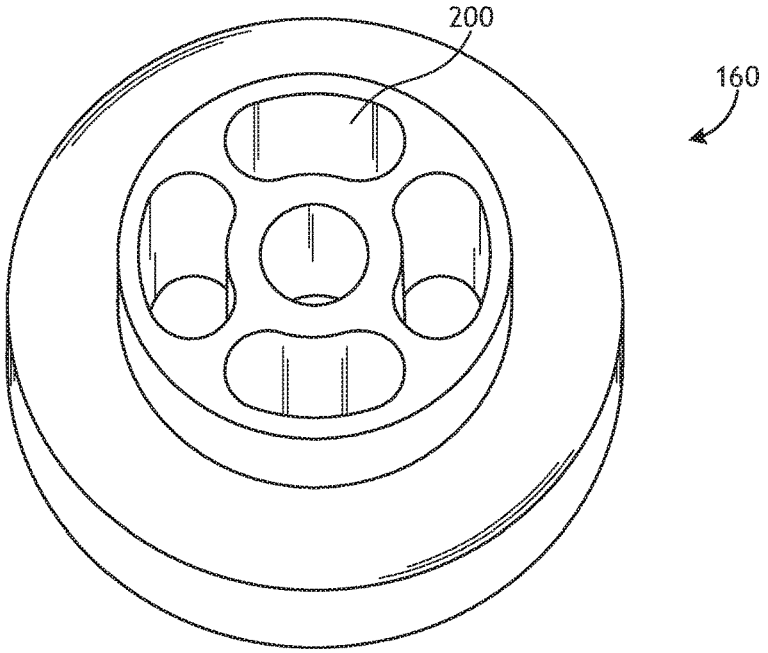
FIG. 2 is a top perspective view of an exemplary embodiment of a gas outlet.

FIG. 2 is a top perspective view of one exemplary embodiment of gas outlet 160. As shown in this particular example, gas outlet 160 has four channels 200 through which gas is received from input chamber 130/130*b* and from which gas is output to one or more inlet valves in the compressor. The size, shape, and number of channels 200 is optional and can be tailored to specific implementations, as will be appreciated by those skilled in the art.

Figure 3:
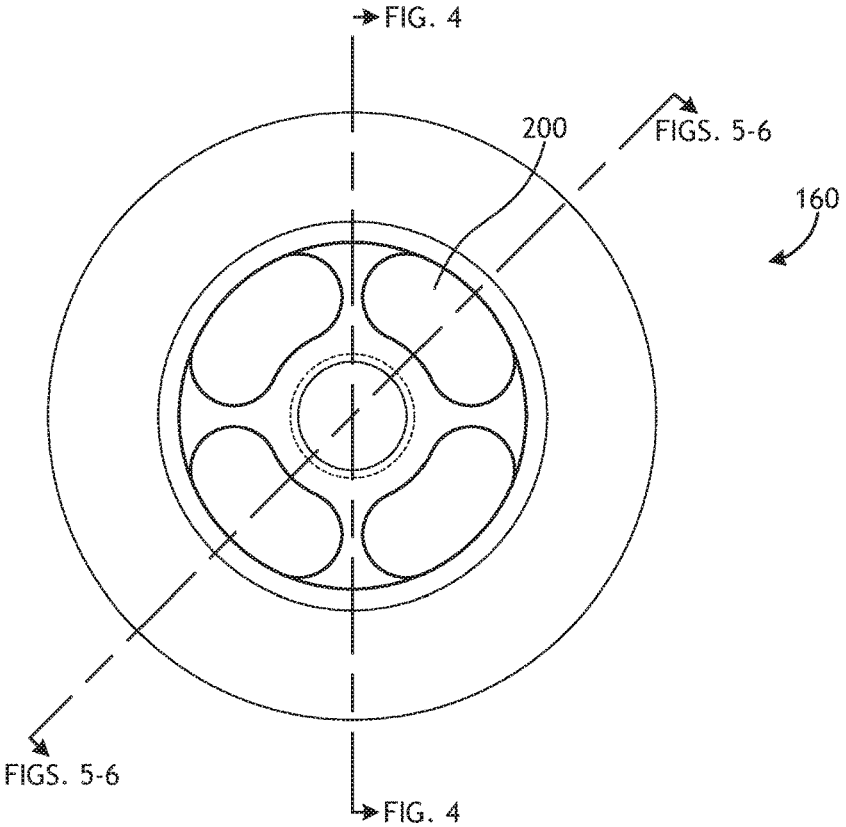
FIG. 3 is a top view of an exemplary embodiment of a gas outlet.
Figure 4:
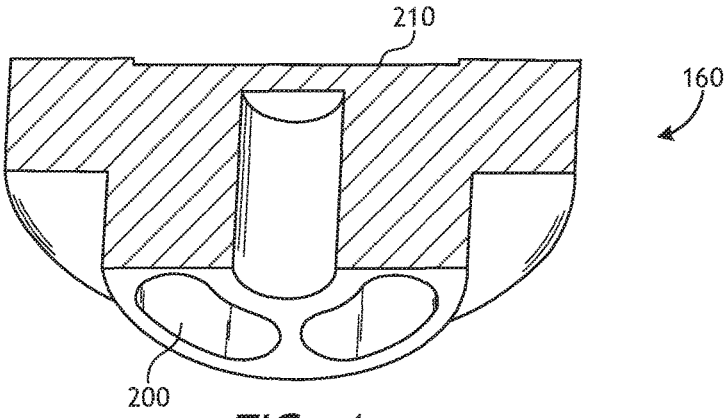
FIG. 4 is a perspective view of a cross section of an exemplary embodiment of a gas outlet.

FIG. 3 is a top view of an exemplary embodiment of gas outlet 160. FIG. 4 is a perspective view of a cross section of an exemplary embodiment of gas outlet 160. This embodiment includes inset 210, which is sized to receive the top of stop plunger 140. In other words, the width/diameter of inset 210 is only slightly larger than the width/diameter of the top of stop plunger 140, with the goal being to form a better seal between the two to better stop the flow of gas from input chamber 130/130*b* to the channels 200 of gas outlet 160.

Figure 5:
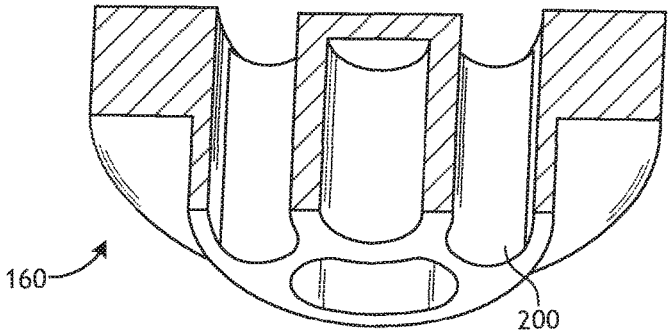
FIG. 5 is a perspective view of a cross section of an exemplary embodiment of a gas outlet.

FIG. 5 is a perspective view of another cross section of an exemplary embodiment of gas outlet 160. This cross section shows channels 200 extending all the way through gas outlet 160, as described above.

Figure 6:
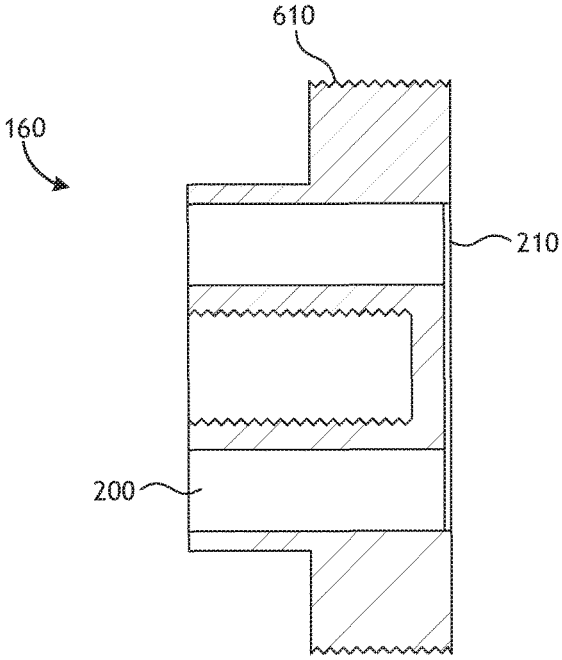
FIG. 6 is a cross section of an exemplary embodiment of a gas outlet.

FIG. 6 is a cross section of an exemplary embodiment of gas outlet 160 showing channels 200 and inset 210. FIG. 6 shows threading 610 for securing gas outlet 160 to gas block 100. These threads, like the size, shape, and number of channels 200, and like the optional nature of inset 210, are optional since other securing means could be used. Likewise, in yet another embodiment, gas block 100 and gas outlet 160 could be machined from the same block.

Figure 7:
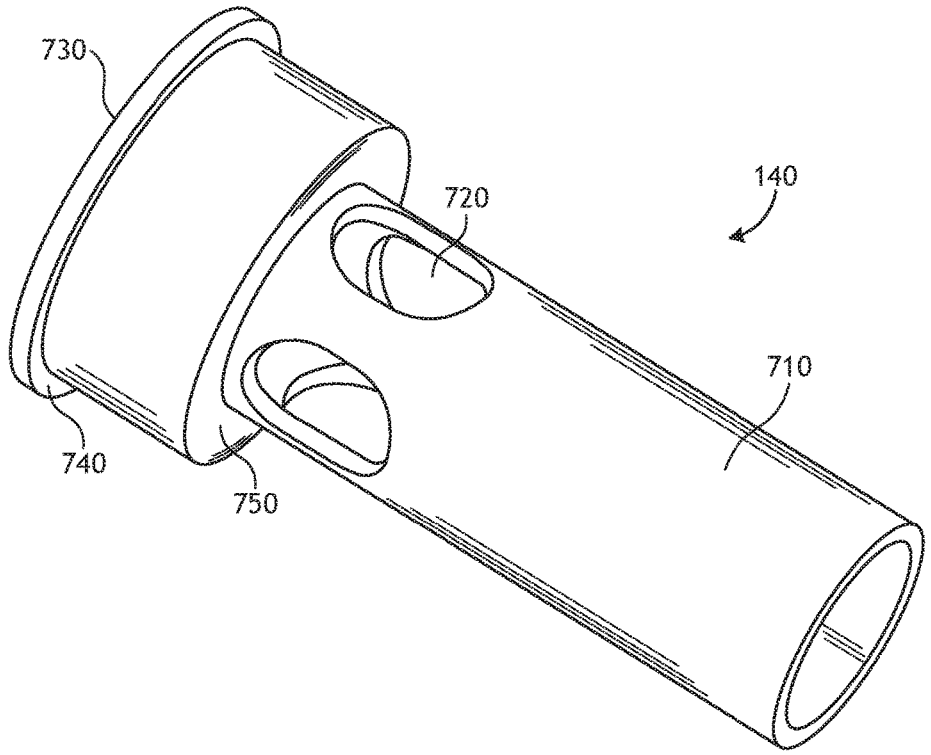
FIG. 7 is a perspective view of an exemplary embodiment of a stop plunger.
Figure 8:
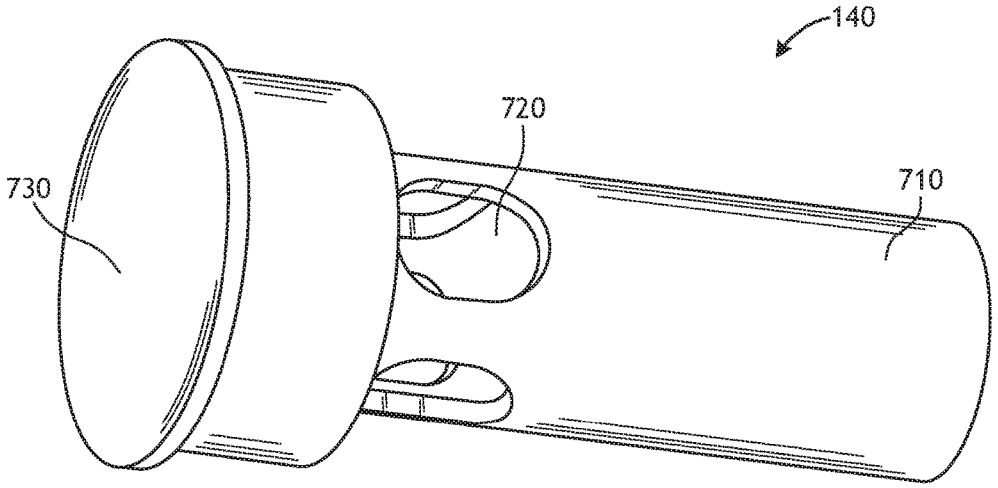
FIG. 8 is a perspective view of an exemplary embodiment of a stop plunger.

FIGS. 7 and 8 are perspective views of one exemplary embodiment of one aspect of stop plunger 140. As shown, stop plunger 140 includes openings 720, through which gas in input chamber 130*a* passes. While stop plunger 140 is shown with four openings 720, a different number (or shape) of openings could be used, as well as the use of no openings since gas in input chamber 130*a* will still exert pressure against surfaces 740 and 750 to cause stop plunger 140 to close when there is sufficiently more pressure in input chamber 130*a* than there is in input chamber 130*b*. As also shown, stop plunger 140 includes surface 730, which is shaped to block the flow of gas from entering channels 200 (in gas outlet 160) when stop plunger 140 moves to a closed position against gas outlet 160. This embodiment of stop plunger 140 also includes an elongated body 710, which is sized to fit within grove 150 of gas block 100 so that stop plunger 140 is able to slide in a controlled manner between its open and closed position. As noted above, in one embodiment, this sliding action may be tempered by one or more o-rings 170 and 180 (shown in FIG. 1) or other movement retarding mechanisms, as described above.

Figure 9:
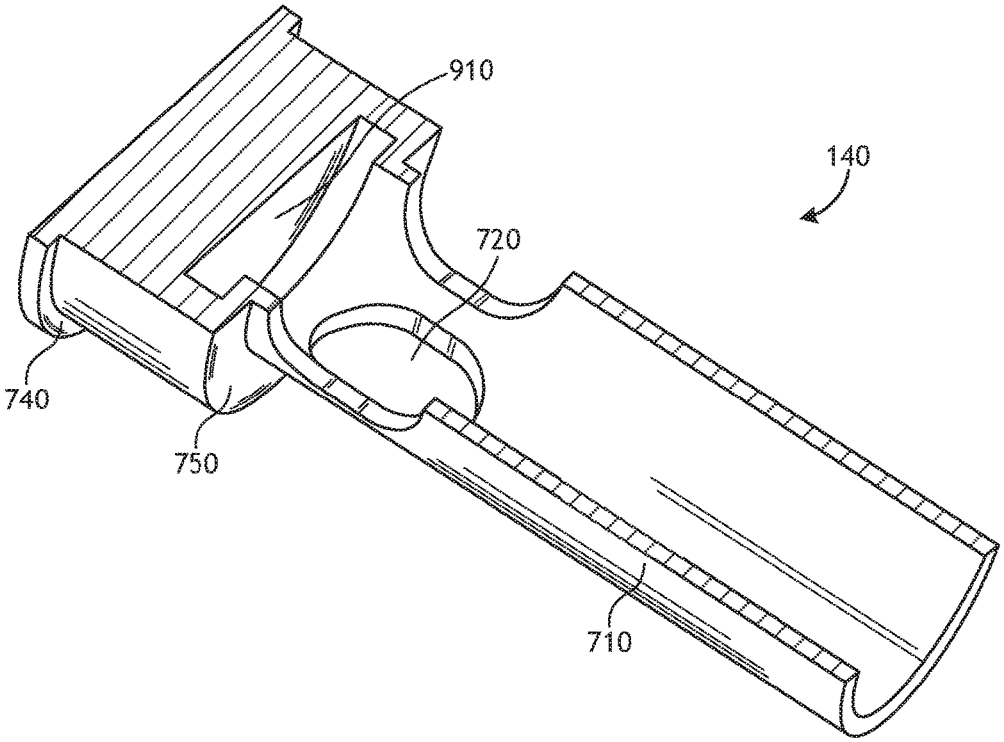
FIG. 9 is a perspective view of an exemplary embodiment of a cross section of a stop plunger.

FIG. 9 is a perspective view of an exemplary embodiment of a cross section of stop plunger 140. This embodiment shows a hollowed out area 910 in the top portion of stop plunger 140, which acts as an additional surface against which the input gas will push, thereby assisting in pushing stop plunger 140 into its closed position against gas outlet 160 when there is sufficiently more pressure in input chamber 130*a* than there is in input chamber 130*b*.

Figure 10:
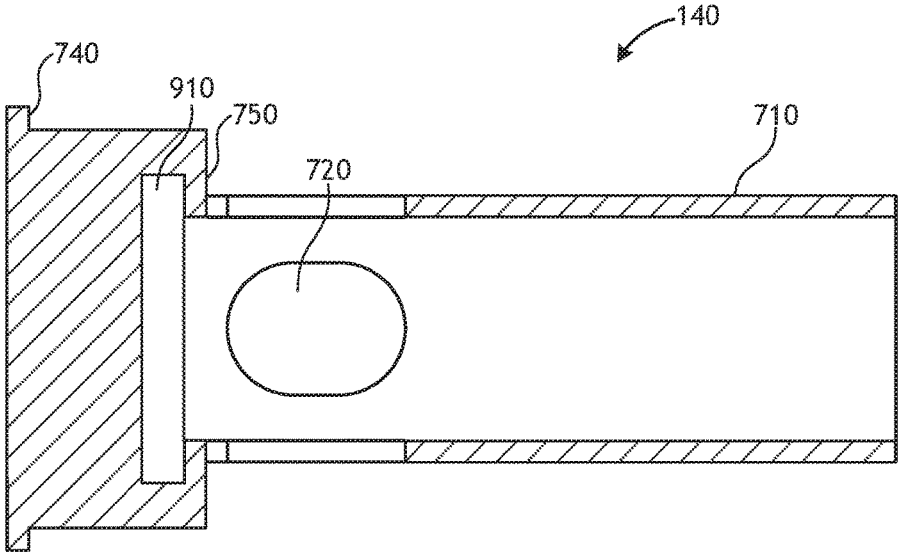
FIG. 10 is a cross section of an exemplary embodiment of a stop plunger.

FIG. 10 is a cross section of an exemplary embodiment of stop plunger 140, which also shows area 910 in the top portion of stop plunger 140.

Figure 11:
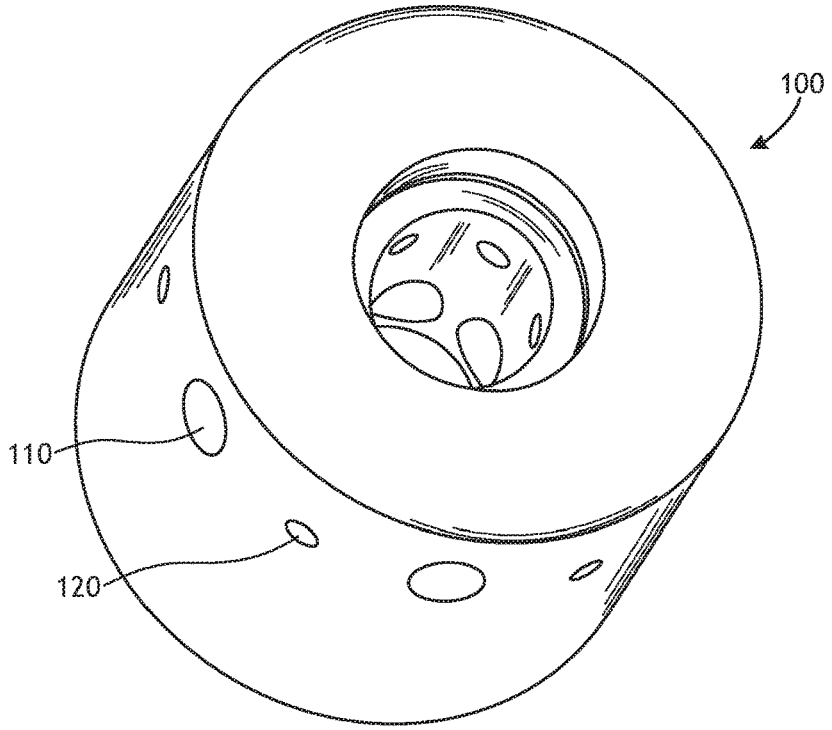
FIG. 11 is a perspective view of an exemplary embodiment of a gas block.

FIG. 11 is a perspective view of an exemplary embodiment of gas block 100 (shown in FIG. 1), without gas outlet 160. As indicated above, gas outlet 160 can be either detachable from or an integrated part of gas block 100. While this embodiment of gas block 100 is illustrated as having a cylinder-like shape, other shapes are possible (and perhaps even desirable depending on the application) and still within the scope of the present invention. Likewise, while gas passageways 110 and 120 are shown as having the same radial placement on the outside of gas block 100, other embodiments could have different radial placements and/or different numbers of gas passageways 110 and 120.

Figure 12:
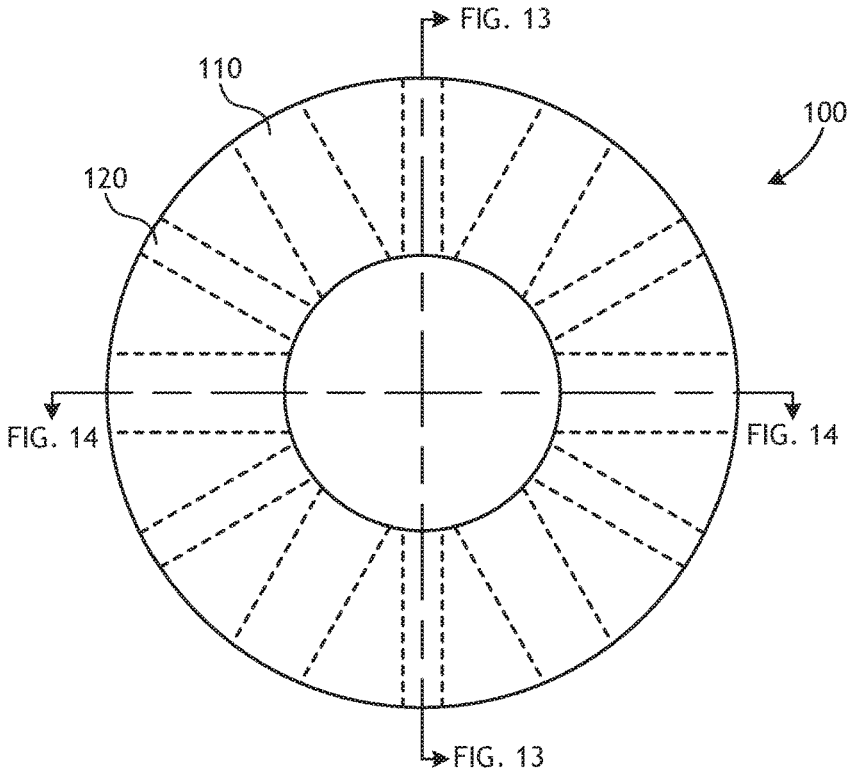
FIG. 12 is a cross section of an exemplary embodiment of a gas block.

FIG. 12 is a cross section of an exemplary embodiment of gas block 100. FIG. 12 shows supporting cross-sectional designations for FIG. 13 and FIG. 14. Like FIG. 11, FIG. 12 shows gas passageways 110 and 120.

Figure 13:
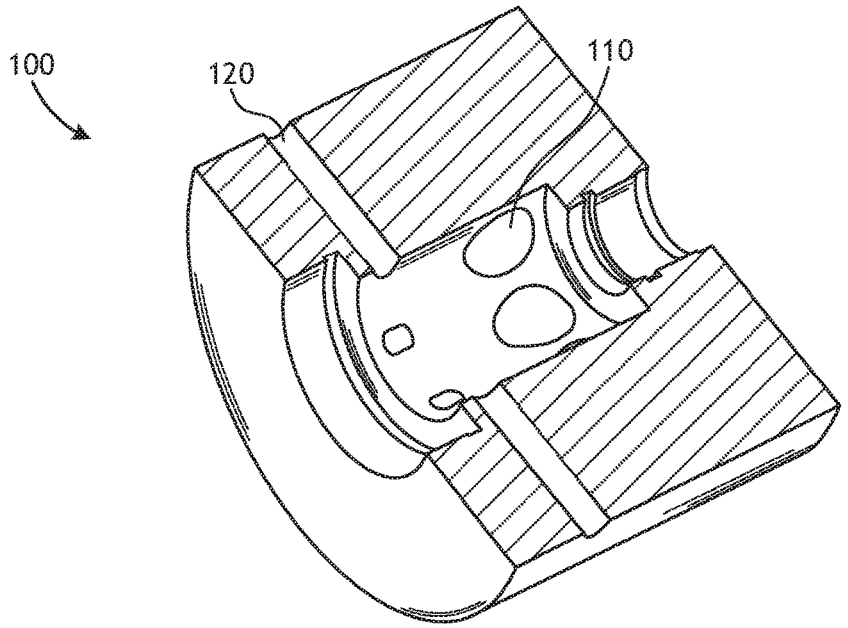
FIG. 13 is a cross section of an exemplary embodiment of a gas block.
Figure 14:
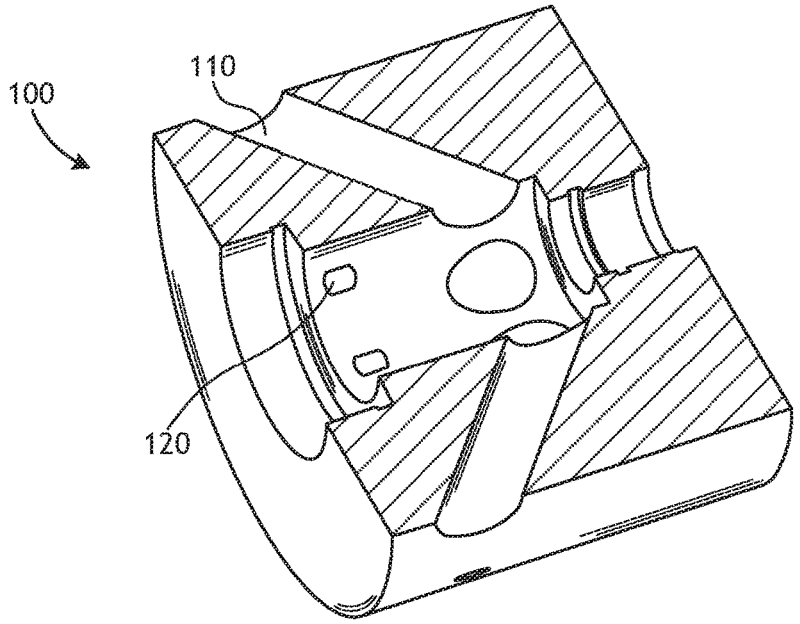
FIG. 14 is a cross section of an exemplary embodiment of a gas block.

FIG. 13 is a cross section of an exemplary embodiment of gas block 100 taken along gas passageway 120, as illustrated in FIG. 12. FIG. 14 is a cross section of an exemplary embodiment of gas block 100 taken along gas passageway 110, as illustrated in FIG. 12. These Figures (like FIGS. 1, 11, and 12) show gas passageways 120 being smaller in diameter than gas passageways 110. In this particular embodiment, this size differential is intended, i.e., gas passageways 110 are made larger than gas passageways 120, although in other embodiments they could be the same.

In yet another embodiment, the sum of the cross-sectional size of gas passageways 120 are made smaller than the sum of the cross-sectional size of the inlets to the piston bore. This size relationship ensures that in the event the piston bore loses pressure (or is exposed to the atmosphere) the gas pressure in input chamber 130*b* will drop below the gas pressure in input chamber 130*a*. As described above, the pressure differential between chamber 130*a* and 130*b* will then cause stop plunger 140 to move to a closed position against gas outlet 160, thereby blocking the flow of gas from entering gas outlet 160 and the inlet valve of the piston bore. In that case, gas from the gas source (being delivered through gas passageway 110 and 120) will cease flowing, thereby preventing gas exposures during compressor failure, breakdown, or other pressure losses.

Figure 15:
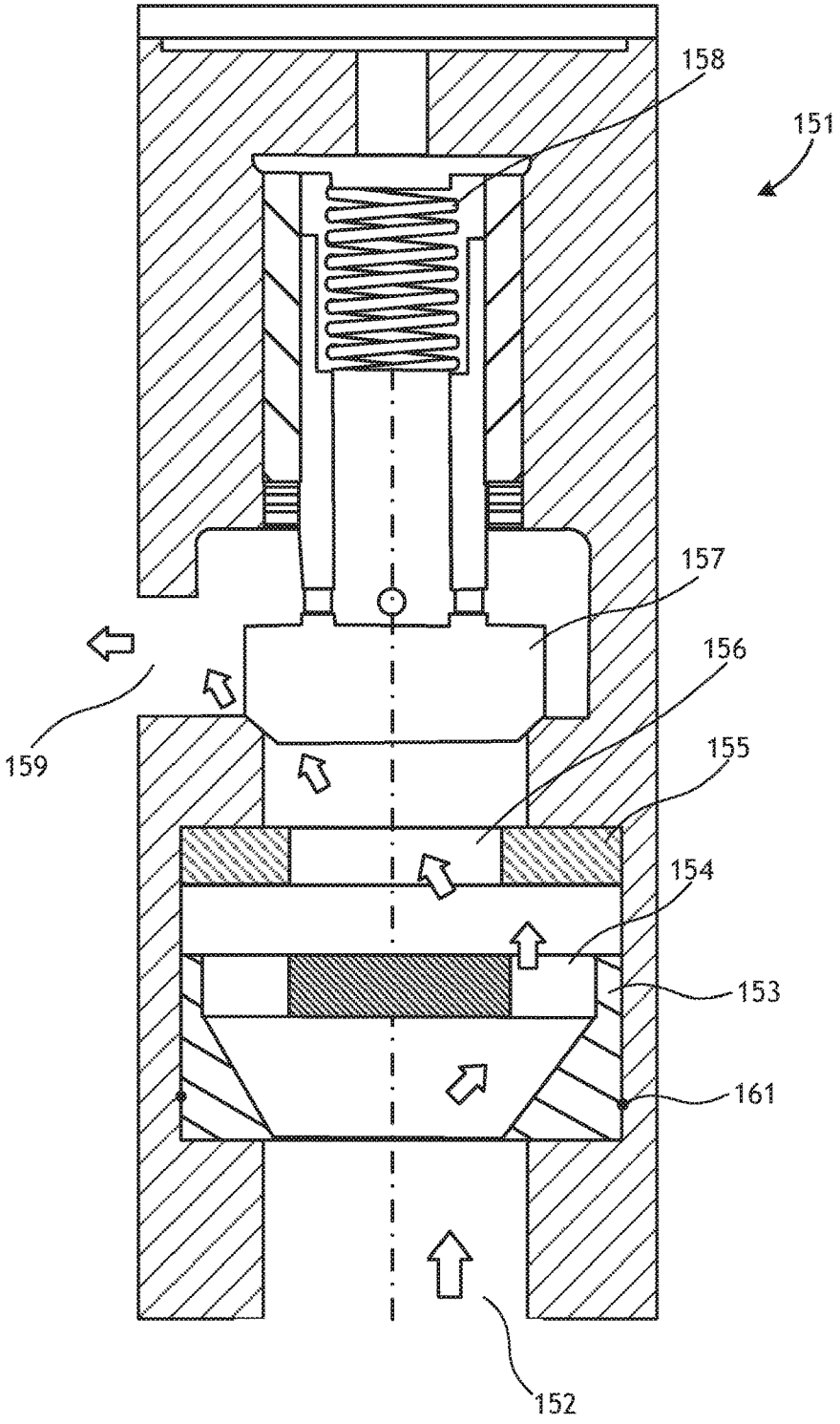
FIG. 15 is a cross sectional view of an exemplary embodiment of a gas block including a poppet.

FIG. 15 is a cross sectional view of another exemplary embodiment of another aspect of the present invention. (As noted above, while references are made to "gas", it should be understood that liquids (or a gas/liquid combination) could also be used without departing from the disclosed invention.) Gas block 151 is shown having gas input passageway 152, stop plunger 153, gas passageway 154, gas stop 155, gas passageway 156, poppet 157, spring 158, and gas output passageway 159. Stop plunger 153 is mounted in gas block 151 so that it is able to slide between an open position (as shown) and a closed position (not shown) against gas stop 155. Gas flow is substantially blocked from flowing when stop plunger 153 is in its closed position.

In operation, gas is supplied from an external source to gas input passageway 152, as depicted by the arrow showing gas flow into that passageway. Given this exemplary embodiment's structure and assuming stop plunger 153 is in its open position, gas supplied to gas input passageway 152 enters stop plunger 153, flows through gas passageway 154, and then flows through gas passageway 156. Pressure from the supplied gas will exert a force against poppet 157 and, if that pressure exerts a force on poppet 157 greater than the combined force exerted on poppet 157 by spring 158 and the gas pressure in gas output passageway 159, poppet 157 will open, thereby allowing gas to flow into gas output passageway 159. Except as described in more detail below, gas will continue to flow from gas input passageway 152 to gas output passageway 159 as long as the force exerted on poppet 157 by the input gas exceeds the combined force exerted on poppet 157 by spring 158 and the gas in gas output passageway 159.

The gas in gas output passageway 159 then flows as conventionally understood, i.e., into a compressor's piston bore (not shown). This described gas flow occurs at least on the down-stroke of the piston and ceases upon the piston's upstroke, at which point gas is forced through an outlet valve (not shown) to a tank or other compressed gas receptacle (not shown). (Note that due to the design of gas block 151, during the piston's upstroke, gas will not reverse flow across/through poppet 157 because poppet 157 will remain closed due to the combined force exerted on poppet 157 by spring 158 and the gas in gas output passageway 159 exceeding the input gas pressure.) Throughout this cycle, i.e., during normal compressor operation, gas pressure in each of gas passageways 152, 154, and 156 is substantially equal, thereby causing stop plunger 153 to remain in its open position (as shown). Movement of stop plunger 153 can be retarded (to deter its movement during shipping, installation, minor pressure differentials, vibration, etc.) by one or more o-rings 161. Other movement retarding mechanisms could also be used instead of (or in combination with) o-ring 161, such as one or more springs, c-rings, or even merely friction between stop plunger 153 and gas block 151.

If the compressor fails in a manner that exposes gas in the piston bore (or anywhere at or downstream of poppet 157) to the atmosphere, or otherwise results in a decrease in pressure in the piston bore, the pressure in gas output passageway 159 will fall below the pressure in gas passageways 152, 154, and 156 because gas output passageway 159 will essentially be open to the atmosphere due to its connection to the piston bore. This pressure differential will then cause poppet 157 to temporarily open until the pressure differential causes stop plunger 153 to move to its closed position against gas stop 155, thereby blocking the flow of gas from entering gas passageway 156, gas output passageway 159, and the piston bore. In that case, harmful gas from the gas source (being delivered through gas passageways 152, 154, 156, and 159) will cease flowing, thereby preventing harmful gas exposures during compressor failure or breakdown.

While various dimensions and geometries of gas block 151 and its constituent components are shown in FIG. 15 (and the other Figures), it should be understood that the invention is not limited to such dimensions and geometries. As one example only, while stop plunger 153 is shown having a flat, circular front surface with a plurality of gas passageways 154 for mating with gas stop 155, the front surface of stop plunger 153 alternately could be spherical or otherwise shaped so long as its shape suitably mates with gas stop 155 to block gas flow when stop plunger 153 is closed. Gas block 151 and its other components could likewise be altered and still fall within the spirit and scope of the present invention.

Figure 16:
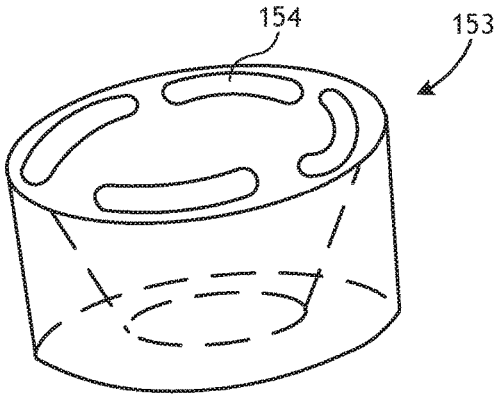
FIG. 16 is a top perspective view of an exemplary embodiment of a stop plunger.

FIG. 16 is a top perspective view of one exemplary embodiment of stop plunger 153. A plurality of gas passageways 154 are shown, but it will be appreciated that a different number of passageways and different geometries could be used to accomplish the same task, so long as those passageways and geometries are inversely reflected by gas stop 155. In other words, stop plunger 153 and gas stop 155 should be designed, in this particular embodiment, to allow gas to flow through gas passageway 154 and gas passageway 156 when stop plunger 153 is open, and to substantially block gas flow through gas passageway 154 and gas passageway 156 when stop plunger 153 is closed.

Figure 17:
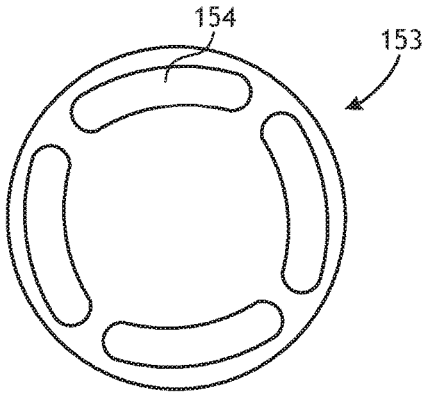
FIG. 17 is a top view of an exemplary embodiment of a stop plunger.
Figure 18:
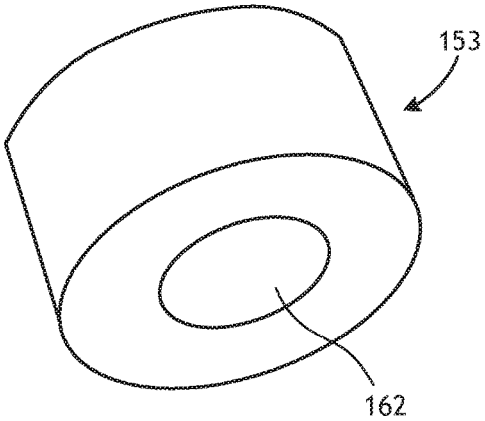
FIG. 18 is a bottom perspective view of an exemplary embodiment of a stop plunger.
Figure 19:
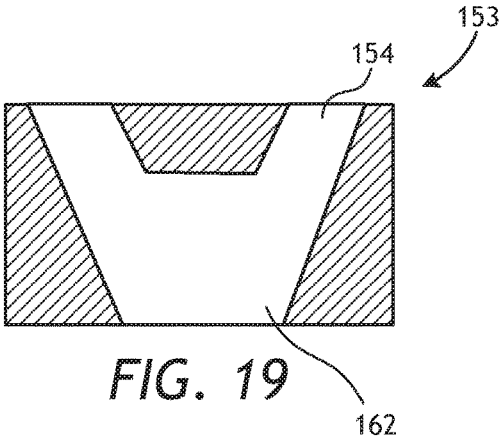
FIG. 19 is a cross section of an exemplary embodiment of a stop plunger.

FIG. 17 is a top view of one exemplary embodiment of stop plunger 153 showing gas passageways 154. FIG. 18 is a bottom perspective view of an exemplary embodiment of stop plunger 153. This embodiment shows a circular passageway 162 for receiving gas from gas input passageway 152. Other shapes are possible. FIG. 19 is a cross section of an exemplary embodiment of stop plunger 153 showing the coupling between (a) the circular passageway 162 for receiving gas from gas input passageway 152 and (b) gas passageways 154.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature, or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes," or "contains" one or more elements possesses those one or more elements but is not limited to possessing only those one or more elements. Similarly, a method or process that "comprises," "has," "includes," or "contains" one or more operations possesses those one or more operations but is not limited to possessing only those one or more operations.

The invention claimed is:

1. An apparatus, comprising:

a first input passageway to an input chamber for connecting to a pressure source, such that the pressure source is able to supply pressure to the first input passageway;

a second input passageway to the input chamber for connecting to the pressure source, such that the pressure source is able to supply pressure to the second input passageway, and the pressure supplied to the second input passageway is always the same as the pressure supplied to the first input passageway;

a stop plunger in the input chamber separating the input chamber into a first input chamber and a second input chamber such that the first input chamber is connected to the first input passageway and the second input chamber is connected to the second input passageway; and an outlet;

whereby the stop plunger blocks the outlet when pressure in the second input chamber exceeds the pressure in the first input chamber.

2. The apparatus of claim 1, wherein the first input passageway allows a medium to pass into the first input chamber, and the second input passageway allows the medium to pass into the second input chamber.

3. The apparatus of claim 2, wherein the stop plunger is mounted in the input chamber so that it moves between a first position and a second position.

4. The apparatus of claim 3, wherein the first position of the stop plunger is between the first input passageway to the input chamber and the second input passageway to the input chamber.

5. The apparatus of claim 4, wherein the second position of the stop plunger blocks the outlet.

6. The apparatus of claim 5, wherein the stop plunger maintains its position in the input chamber when pressure in the first input chamber is equal to the pressure in the second input chamber.

7. The apparatus of claim 6, wherein the first input passageway has a smaller cross-sectional area than the cross-sectional area of the second input passageway.

8. The apparatus of claim 7, wherein pressure in the second input chamber exceeds the pressure in the first input chamber during a compressor failure.

9. The apparatus of claim 8, wherein friction on the stop plunger retards its movement within the input chamber.

10. The apparatus of claim 9, wherein an o-ring supplies the friction.

11. The apparatus of claim 9, wherein the first input passageway to the input chamber includes a plurality of passageways.

12. The apparatus of claim 11, wherein the second input passageway to the input chamber includes a plurality of passageways.

13. A gas block, comprising:

a gas input passageway for receiving gas from a gas pressure source and for delivering gas to a gas input chamber;

a stop plunger that divides the gas input chamber into a first gas input chamber and a second gas input chamber, whereby gas pressure in the first gas input chamber and gas pressure in the second gas input chamber is sourced by the gas pressure source such that the gas pressure supplied by the gas pressure source to the first gas input chamber is always the same as the gas pressure supplied by the gas pressure source to the second gas input chamber; and a gas outlet;

whereby the stop plunger blocks the gas outlet when gas pressure in the second gas input chamber exceeds the gas pressure in the first gas input chamber.

14. The gas block of claim 13, wherein the gas outlet receives gas from the gas input chamber.

15. The gas block of claim 14, wherein the gas input passageway includes a first passageway for delivering gas to the first gas input chamber and a second passageway for delivering gas to the second gas input chamber.

16. The gas block of claim 15, wherein the first passageway includes a plurality of passageways.

17. The gas block of claim 16, wherein the second passageway includes a plurality of passageways.

18. The gas block of claim 15, wherein the first passageway has a smaller cross-sectional area than the cross-sectional area of the second passageway.

19. The gas block of claim 18, wherein the stop plunger is mounted in the gas input chamber so that it moves between a first position and a second position.

20. The gas block of claim 19, wherein the first position of the stop plunger is between the first passageway and the second passageway.

21. The gas block of claim 20, wherein the second position of the stop plunger blocks the gas outlet.

22. An apparatus, comprising: a first input passageway to a first input chamber; a second input passageway to a second input chamber; a stop plunger separating the first input chamber and the second input chamber; and an outlet fluidly connected to the first input passageway; whereby the stop plunger blocks the outlet when pressure in the second input chamber exceeds the pressure in the first input chamber, and whereby the first input passageway has a smaller cross-sectional area than the cross-sectional area of the second input passageway.

23. The apparatus of claim 22, wherein pressure in the second input chamber exceeds the pressure in the first input chamber during a compressor failure.

24. The apparatus of claim 23, wherein friction on the stop plunger retards its movement within the input chamber.

25. The apparatus of claim 24, wherein an o-ring supplies the friction.

26. The apparatus of claim 24, wherein the first input passageway to the input chamber includes a plurality of passageways.

27. The apparatus of claim 26, wherein the second input passageway to the input chamber includes a plurality of passageways.

28. A gas block, comprising:

a gas input passageway for delivering gas to a gas input chamber;

a stop plunger that divides the gas input chamber into a first gas input chamber and a second gas input chamber; and a gas outlet for receiving gas from the gas input chamber;

whereby the stop plunger blocks the gas outlet when gas pressure in the second gas input chamber exceeds the gas pressure in the first gas input chamber, whereby the gas input passageway includes a first passageway for delivering gas to the first gas input chamber and a second passageway for delivering gas to the second gas input chamber, and whereby wherein the first passageway has a smaller cross-sectional area than the cross-sectional area of the second passageway.

29. The gas block of claim 28, wherein the stop plunger is mounted in the gas input chamber so that it moves between a first position and a second position.

30. The gas block of claim 29, wherein the first position of the stop plunger is between the first passageway and the second passageway.

31. The gas block of claim 30, wherein the second position of the stop plunger blocks the gas outlet.

* * * * *